US005273471A

United States Patent [19]

Molnar

[11] Patent Number: 5,273,471

[45] Date of Patent: Dec. 28, 1993

[54] FIN FOR A WINDSURF BOARD

[75] Inventor: Ferenc Molnar, Micheldorf, Austria

[73] Assignee: F2 International Ges. m.b.H., Kirchdorf/Krems, Austria

[21] Appl. No.: 931,833

[22] Filed: Aug. 18, 1992

[30] Foreign Application Priority Data

Aug. 19, 1991 [DE] Fed. Rep. of Germany ..... 4127410
Apr. 3, 1992 [DE] Fed. Rep. of Germany ..... 4211257

[51] Int. Cl.[5] ..... B63H 5/06
[52] U.S. Cl. ..... 441/79
[58] Field of Search ..... 441/74, 79; 114/126, 114/127, 140-143, 274, 275, 279, 281

[56] References Cited

U.S. PATENT DOCUMENTS 4,940,438 7/1990 Miller ..... 441/79
4,949,919 8/1990 Wajnikonis ..... 114/127

FOREIGN PATENT DOCUMENTS 0079113 5/1983 European Pat. Off. .
0092785 11/1983 European Pat. Off. .
0245571 11/1987 European Pat. Off. .
3215235 11/1983 Fed. Rep. of Germany .
3246126 6/1984 Fed. Rep. of Germany .
3634445 4/1988 Fed. Rep. of Germany .

OTHER PUBLICATIONS

French Search Report of Jul. 24, 1992.
Surf Magazin, Mar. 1989, issue 3, pp. 82-83.
Surf Magazin, Apr. 1983, issue 4, pp. 117-119 "Are we using the wrong fins?" by Jim Drake.

*Primary Examiner*—Jesûs D. Sotelo
*Attorney, Agent, or Firm*—Ralph H. Dougherty

[57] ABSTRACT

A fin (1) for a windsurf board is constructed from fibers (5) which have a preferred fiber direction with the majority of the fibers lying in this direction, the preferred direction extending at an acute angle (a) to the longitudinal axis (4) of the profile of the fin blade (2). This allows the fin to distort and to change the properties of its profile in a defined manner when loaded.

8 Claims, 8 Drawing Sheets

FIN FOR A WINDSURF BOARD

The present invention relates to a fin for a windsurf board.

A fin, having the form of an aerofoil blade attached to the hull of the sailboard, essentially serves to provide directional stability and allows the user to tack against the wind. The fin transmits the transverse forces originating from the sail (running crosswise to the direction of travel) to the water. Consequently, the water does not flow against the fin exactly in the direction of travel but at an angle to the direction of travel, called the "drift". Because the water flows against the fin obliquely, a buoyant force in then generated on the windward side (relative to the wind direction) which counteracts the drift.

If there is an increase in the angle of drift, which in terms of its effect can also be regarded as the angle of incidence between the central plane of the fin blade and the flow direction of the water, the flow against the fin blade separates and the fin blade can no longer fulfill its function as a directional stabilizer. This separation of the flow is also described as "stalling" or, in the language of windsurfers, as "spin out", because on separation of the flow from the fin blade, the fin blade cannot longer provide for forces perpendicular to its plane and therefore the stern (tail) of the Surfboard suddenly spins out.

As can be seen from the curve a in FIG. 1 , this stalling occurs abruptly, since the flow along the fin separates more or less abruptly.

On the other hand, a certain angle of incidence or a drift is desirable if the required buoyant force is to be generated at all and in order that the windsurfer can "head up", i.e., tack against the wind.

Several variants have been proposed in order to solve this problem:

One variant provides a so-called forefin, i.e., a fin which is very small in comparison with the fin blade and which is arranged a few centimeters in front of the leading edge of the fin blade. Like the headsail of a sailing boat, this forefin is intended to accelerate the flow in the upper region of the fin blade on the shaft side and thus to delay the separation of the flow. However, because a fin blade needs to be symmetrical in cross-section, since the surfboard is intended to sail in both directions of travel (port and starboard), the forefin cannot produce the desired effect, since it is also symmetrical and needs to be located in the central plane of the fin blade. The forefin could only produce the desired effect if it were arranged offset in relation to the central plane of the fin blade, but this is not possible since the surfboard is intended to be sailed in both directions.

A similar measure consists in providing a longitudinal slit in the fin blade in the region located on the shaft side and pointing in the direction of travel, so that the part located in front of this longitudinal slit acts as a type of forefin. This measure has not had the desired success either.

Furthermore, it should be taken into account that the positive buoyancy of the fin blade is not only dependent on the angle of incidence but also on the speed of the water flowing past. At "zero" flow, there is of course no positive buoyancy. As FIG. 2*a* shows, the buoyant force first rises steeply with the speed, then passes over into a flatter region and, after a new smaller rise, then falls relatively abruptly, showing the so-called "stalling". Finally, it should also be taken into account that the flow resistance or resistance to travel of the fin rises with the speed in a non-linear manner and is very high in the region of the stall. Tests carried out by the applicants have shown that, up to average speeds of approximately 20 to 30 km/h, the danger of stalling does not occur, but that at higher speeds above 30 km/h measures should be taken to prevent stalling.

The principal object of the invention is to provide an improved fin for a windsurf board with improved properties for a certain speed range.

In particular, the object of the invention is to provide a fin for the higher speed range so that separation of flow occurs more gently (and not abruptly). In addition, for the lower speed range, the fin has an improved buoyant force.

In accordance with the basic principle of the invention, the fin is constructed so that it distorts or twists under the acting transverse forces in such a manner that its angle of incidence changes in relation to the current flowing past it. This change varies in the longitudinal direction of the fin, i.e., the angle of incidence in the region of the free end is different to that in the region of the shaft of the fin.

In fins for high speeds, which are primarily intended to prevent stalling, the fin distorts in such a manner that the angle of incidence in the region of the free end of the fin is smaller than the angle of incidence in the region of the fin shaft. The lower part of the fin is consequently relieved of its load, thus reducing the danger of stalling. Anyway, the upper part of the fin (on the shaft side) only generates a small portion of the buoyant force at high speeds, since at high speeds there is a mixture of air and water in the region of the water near the surface, whose density p is lower than that of water with no air bubbles on account of the proportion of air.

Conversely, a fin for the lower speed range can distort in such a manner that the angle of incidence in the region of the free end of the fin blade is greater than in the region of the shaft. Because of this increased angle of incidence, the buoyant force is increased and the surfboard heads up better.

These basic principles are achieved in that the fin blade is constructed from fibers, for example laminated, where the fibers have a predominant direction, i.e., the majority of fibers extend in one direction. Previous glass-fiber fabrics for fins made of glass-fiber-reinforced plastic consisted substantially of a fabric with warp threads and weft threads extending at right angles to one another. The proportion of warp threads and the proportion of weft threads was substantially the same.

However, the invention uses thread layers where the majority of fibers are oriented in one direction and which are only held in the bond by a very small proportion of fibers extending substantially crosswise thereto. On account of the material, a fin constructed from such layers of "monofilament" fibers therefore has a different bending resistance in relation to the fiber direction and a direction extending crosswise thereto. The bending resistance relative to the fiber direction is greater than the bending resistance crosswise to the fiber direction. The distortion properties of the fin can be changed by varying the fiber direction in relation to the longitudinal axis of the fin blade profile. In the case of a body shaped in the manner of an aerofoil wing, the term profile line denotes a line which extends along the maximum thickness of the profile. In aerofoil sections, this profile line is located approximately 32–35% of the distance between the leading and trailing edges and extends roughly parallel to the leading edge. The axis or longitudinal axis of the section then bisects the profile line. Depending on whether the fiber direction is inclined forwards or backwards in relation to the longitudinal axis of the profile, the fins produced distort differently: a fin is either a "twisting" fin or an "untwisting" fin. For the following explanations, the terms "inclined forwards" or "inclined backwards" are defined as follows: the fiber direction is inclined forwards in relation to the longitudinal axis of the profile if the fiber and pointing towards the free end of the fin lie further forwards in the direction of travel than the ends pointing in the direction of the fin shaft. Conversely, the fiber direction is inclined backwards in relation to the longitudinal axis of the profile if the fiber ends pointing towards the free end of the fin blade lie further back in the direction of travel than the fiber ends pointing towards the fin shaft.

Where the fiber direction is inclined forwards, the fin is more resistant to distortion in the region of the leading edge than in the region of the trailing edge. The region of the trailing edge will distort more under acting transverse forces and consequently reduce the angle of incidence in relation to the flow, thus easing the load on the fin. Conversely, where the fiber direction is inclined backwards, the region of the leading edge of the fin is less resistant to distortion than that of the trailing edge. Under acting transverse forces, the leading edge will yield to the load and consequently increase the angle of incidence, described as an "untwisting" fin. In both cases the distortion, i.e., the change in the angle of incidence, is greater in the region of the free end of the fin than in the region of the end on the shaft side, since the fin blade can be regarded as being firmly clamped on the fin shaft.

The distortion effect of the fin blade can be increased or reduced if the fin blade is swept forwards (in the direction of travel) or backwards. Here, the term "swept" refers to the inclination of the longitudinal axis of the profile in relation to the direction of travel. If a forward-swept fin blade bends as a result of transverse forces, its upward bending increases the angle of incidence in relation to the flow. Conversely, a backward-swept fin blade will reduce the angle of incidence at the free end of the fin blade. However, through the selection of the fiber direction, it is also possible to give a backward-swept fin a twisting effect and, conversely, to give a forward-swept fin an untwisting effect.

A further embodiment of the invention provides a triangular profiled body at the front end of the fin blade (relative to the direction of travel) on the shaft side, which profiled body needs to have certain dimensions. The specific aim of this triangular profiled body is to cause turbulence, and the turbulence produced in this manner flows along the upper region of the fin blade on the shaft side and has the effect that the main flow is guided along the fin blade by this turbulence. The forces of this deliberately produced turbulence prevent a premature separation of the main flow in the (upper) region of the fin blade on the shaft side. Stalling is delayed by the fact that the flow is in contact with the upper region longer. This measure can also be combined with one or both of the aforementioned measures.

In the following, the invention is explained with reference to the several embodiments shown in the appended drawings, in which:

FIG. 1 is a graph showing the positive buoyant force against the angle of incidence for a conventional fin and a twisting fin according to the invention.

FIG. 2*a* is a graph showing the buoyant force against the travelling speed of a conventional fin and a fin according to the invention.

FIG. 2*b* is a corresponding graph showing the resistance to travel against the speed.

Figure 1:
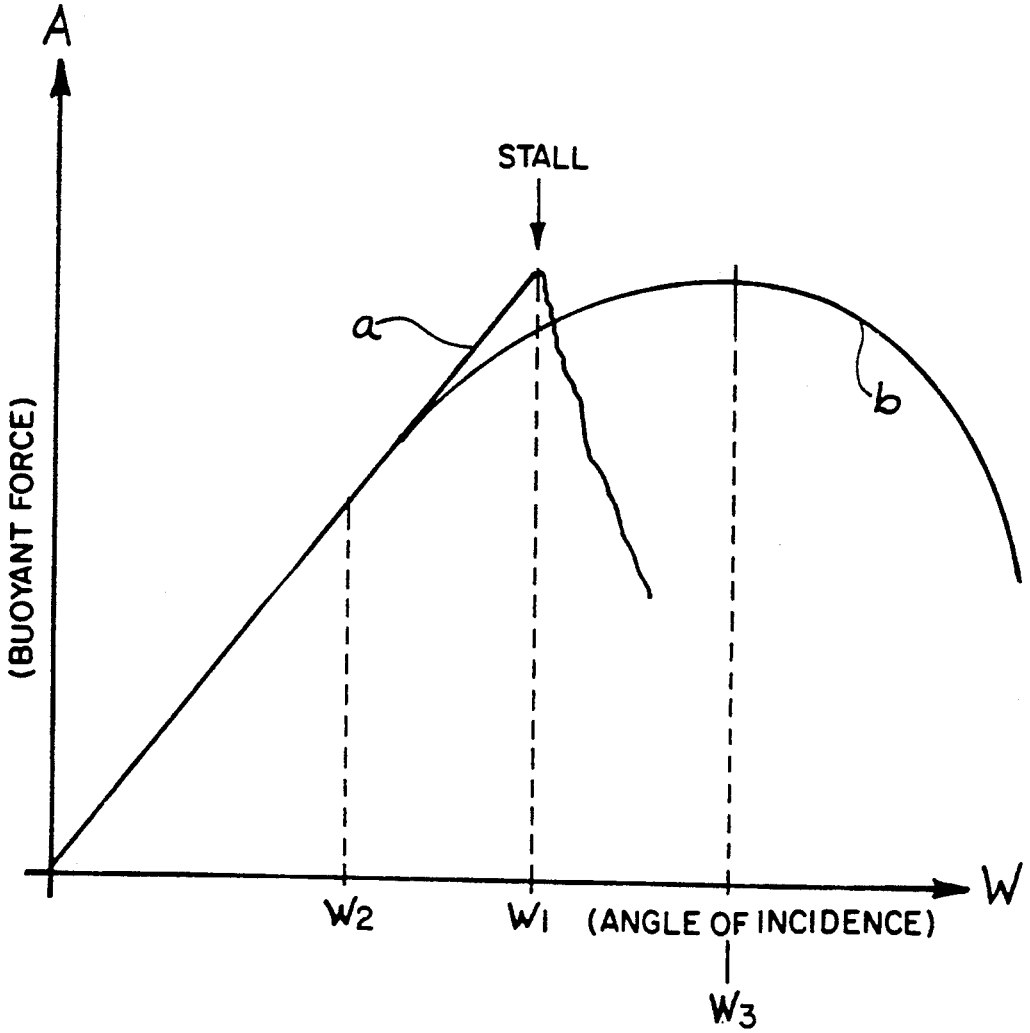

The curve a in FIG. 1 shows the positive buoyant force A plotted against the angle of incidence W (=drift) of a conventional fin blade. In a somewhat idealized fashion, the positive buoyant force increasing with the angle of incidence in a linear manner until, at an angle of incidence W1, the flow separates in an almost abrupt manner and so-called stalling occurs. A further increase in the angle of incidence then only leads to a further decrease in the positive buoyant force.

The curve b shows the conditions in the case of a twisting fin according to the invention. As from a drift W2, the curve rises more gently since a part of the positive buoyant force is lost as a result of the smaller angle of incidence at the free end of the fin blade. However, the curve b also illustrates that the apex does not occur until a larger drift W3 has been reached and that the region of flow separation extends from the very beginning to a total loss of the positive buoyant force (W2–W3) and has a gentle curve in terms of travel. In this region, the windsurfer can therefore take countermeasures, e.g. changing course, slackening the sail, displacing his weight, etc.

Figure 2A:
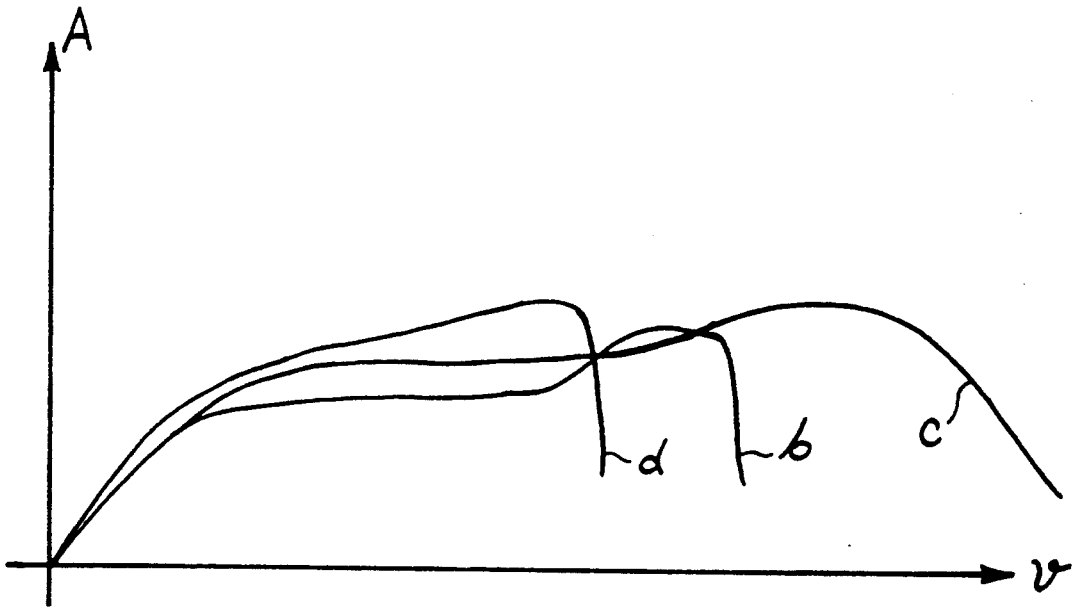

FIG. 2*a* shows the positive buoyancy of a fin blade plotted against the flow velocity v. The line b shows the curve of a conventional fin, the line c shows the curve of a twisting fin and the line d shows the curve of an untwisting fin according to the invention. As from the zero point, the line b first rises in a roughly linear manner and then passes over into a somewhat flatter region, which can be explained by turbulence. After a further rise, the curve then slopes off almost abruptly. The flow has separated, stalling has occurred and any further increase in the angle of incidence only leads to a decrease in the buoyancy.

In the lower speed range, the line c is substantially the same as the line b, but is already above the line b in the average speed range since the turbulence starts later when the load first eases off. However, particular emphasis should be given to the range of high speeds in which the drop occurs very much later than in the other fins and, in addition, has a much smoother curve. The line d of an untwisting fin has a similar curve, but with the difference that the untwisting increases buoyancy in the lower and above all in the average flow range, though the stall still occurs at relatively low speeds. This fin is therefore suitable for low and average speed ranges, but less suitable for high speeds.

Figure 2B:
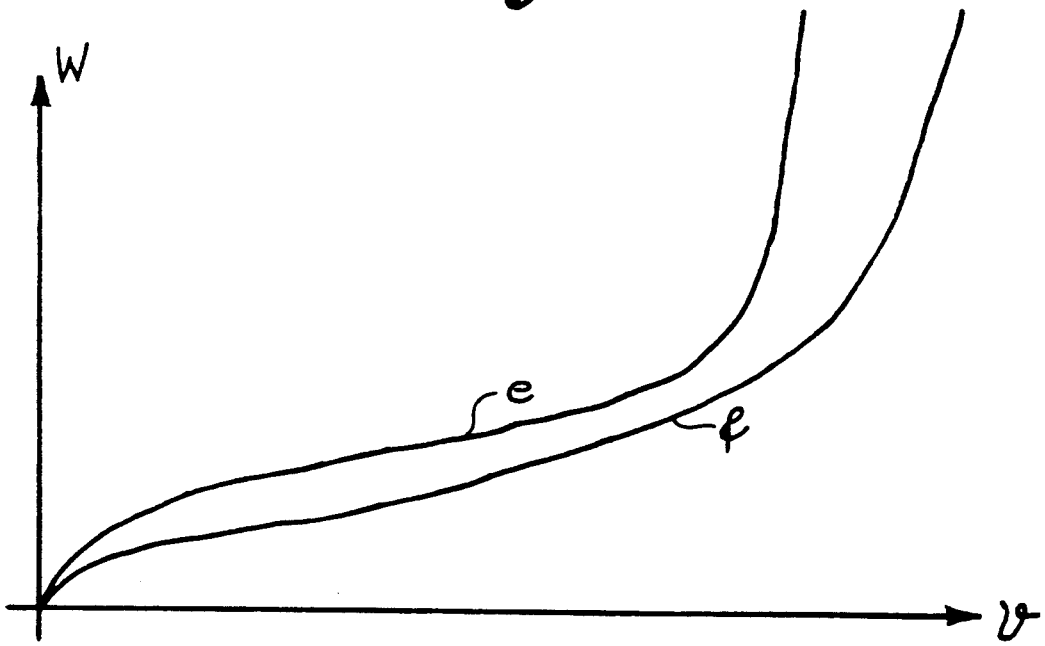

FIG. 2*b* shows the resistance to travel W in dependence upon the speed of travel. The curve e shows the pattern of a conventional fin and illustrates the stall through the steep rise at the end. The curve f shows the pattern of a twisting fin and illustrates that the resistance to travel is lower over practically the entire speed range and the steep rise also only occurs at very much higher speeds.

Figure 3:
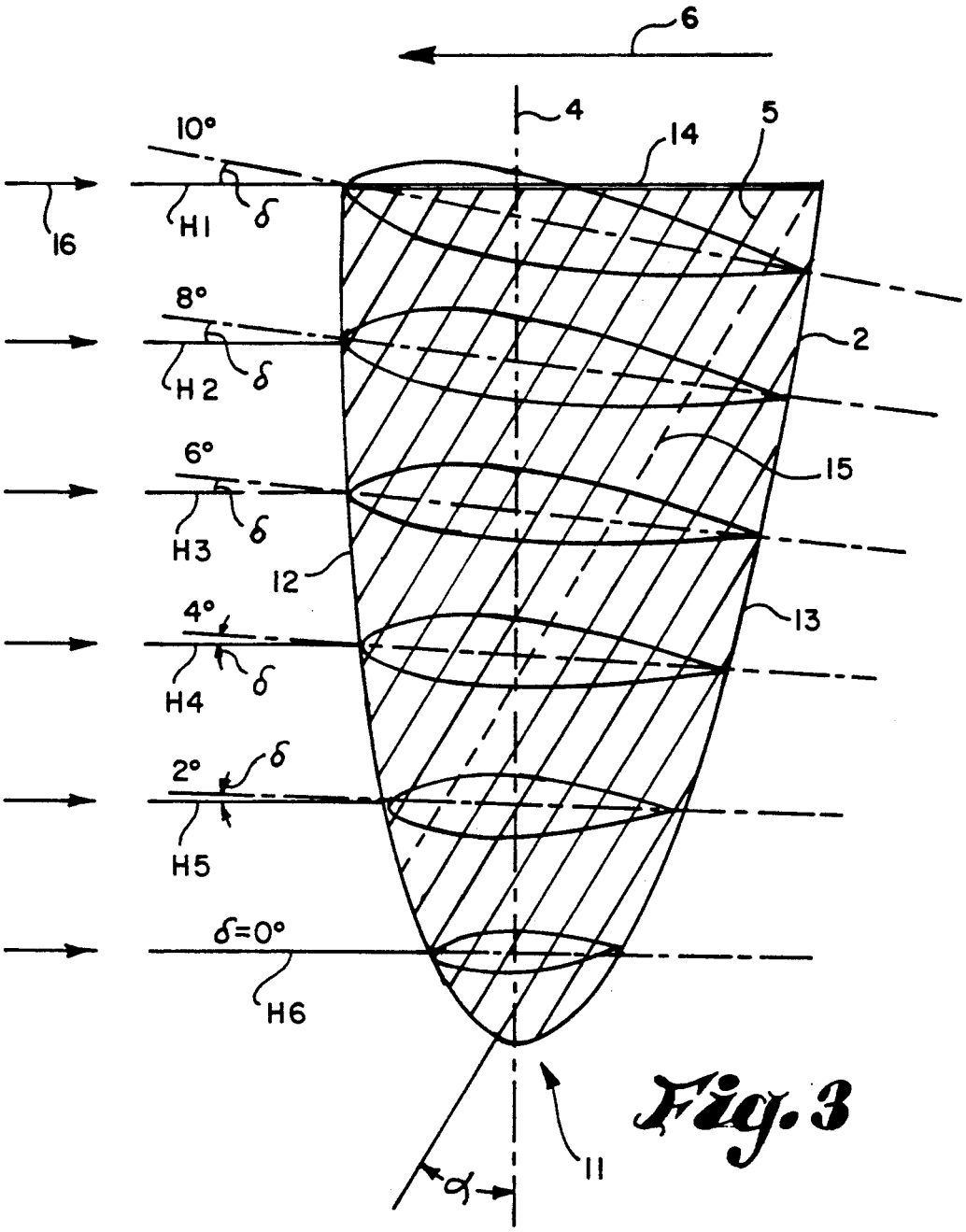
FIG. 3 is a side view of a twisting fin with longitudinally diverging contour lines and profile cross-sections drawn in to illustrate the distortion of the fin.

FIG. 3 shows a twisting fin in accordance with the invention. The fin blade 2 is constructed mainly of "monofilament" fibers, whose longitudinal axis 5 is inclined forwards at an angle $\alpha$ in relation to the longitudinal axis 4 of the fin blade profile. The free end of the fin is designated 11, the end leading into the fin shaft (not shown) is designated 14, the leading edge is designated 12 and the trailing edge is designated 13. The region of fibers whose end extends to the top edge 14 is delimited by a dotted line 15. The roughly triangular region defined by this line 15, the top edge 14 and the leading edge 12 is more resistant to distortion than the region on the other side of the line 15 because the ends of the fibers are clamped in the shaft. When a lateral load is applied (force component perpendicular to the drawing plane), the fin will therefore distort in the latter region as it yields to the load. This is illustrated by the profile cross-sections drawn in at different contour lines H1 to H6. At the end 14 on the shaft side, the profile cross-section has an angle of incidence $\delta$ of 10 degrees in relation to the flow indicated by the arrow 16. The respective angle of incidence $\delta$ decreases at the contour lines H2 to H6 nearer the free end 11 and can even be 0° near the free end, which clearly shows the way the load on the fin eases off. At high speeds, flow separation will therefore start in the region on the shaft side where it does not have any damaging effects because the density of the water is reduced by admixtures of air.

Figure 4:
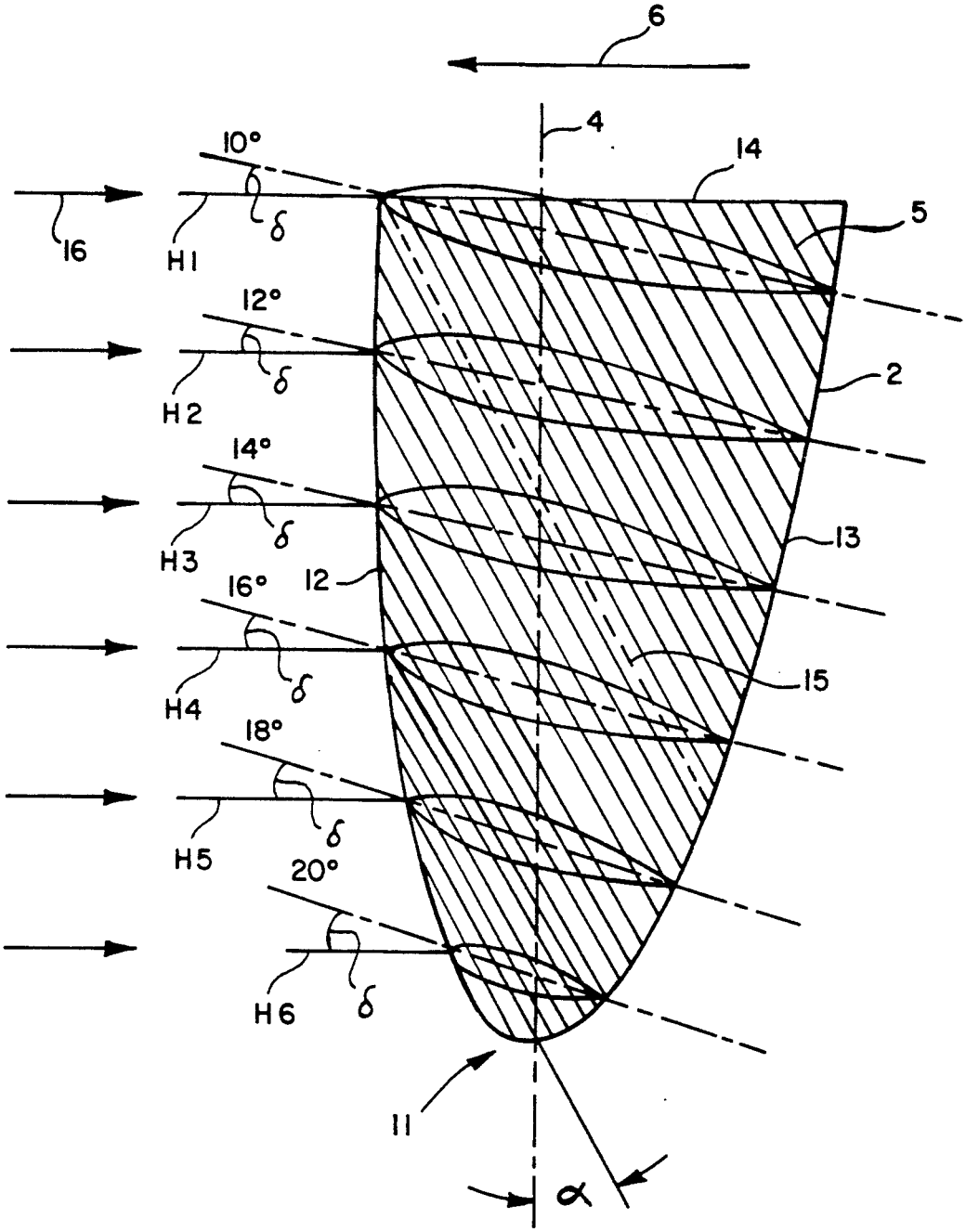
FIG. 4 is a corresponding representation of an untwisting fin.

In an analogous manner, FIG. 4 shows the conditions in the case of an untwisting fin. The region located between the top edge 14, the dotted line 15 and the trailing edge 13 is more resistant to distortion, whereas the region located towards the leading edge 12 is softer and distorts when a load is applied, thus increasing the angle of incidence $\delta$ in relation to the flow 16. For example, if the angle of incidence $\delta$ is 10 degrees in the region 14 on the shaft side, it increases towards the free end 11 and may be, e.g., 20 degrees at the lowest contour line H6. Because of this behavior, described as "untwisting", buoyancy increases in the average speed range and the windsurfer can head up against the wind better because of the increased buoyant force, However, at very high speeds, on account of the increased angle of incidence $\delta$ at the free end 11 of the fin, the flow will separate earlier there and stalling will occur earlier.

In both embodiments (FIG. 3 and FIG. 4), the respective behavior of the fin can be adjusted by varying the angle $\alpha$. The smaller the angle $\alpha$, the more resistant the fin is to distortion, and tests carried out by the applicant have shown that angles of up to a maximum of 40 degrees are appropriate. Beyond this angle, the bending resistance of the fin becomes unfavorable. Theoretically, the angle $\alpha$ can also be 0. The fin then exhibits an untwisting behavior in the region of the leading edge 12 and a twisting behavior in the region of the trailing edge 13.

In addition, the arrow 6 in FIGS. 3 and 4 behavior the direction of travel, which runs contrary to the flow direction 16.

Figure 5:
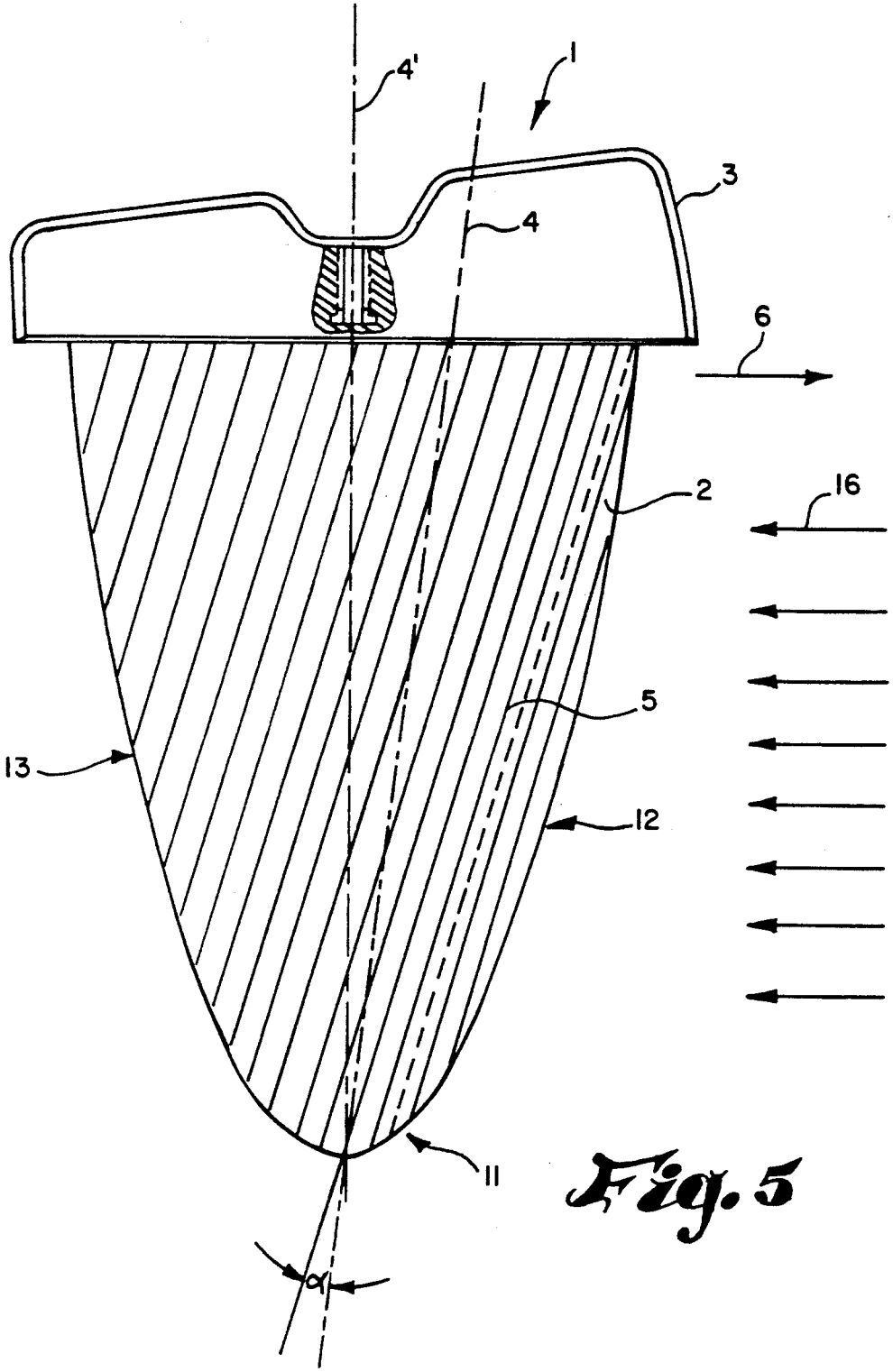
FIG. 5 is a side view of an untwisting fin showing the fin shaft.

The untwisting fin 1 in FIG. 5 has a fin blade 2 and a fin shaft 3, which is fastened in a fin box on the underside of the windsurf board. The fin blade 2 is constructed mainly of monofilament fibers 5 which run parallel to one another in one direction. Conventional fins were constructed of glass fiber fabrics woven in a bidirectional manner. In contrast, the fibers in the embodiment in FIG. 5 are unidirectional. The fibers 5 are inclined at an angle $\alpha$ in relation to the longitudinal axis 4 of the fin profile, so that the ends of the fibers on the shaft guide are further forwards in the direction of travel 6 than the ends of the fibers facing away from the shaft 3. A force component acting on the fin blade 2 transversely to the main plane (i.e., the plane of the drawing) cases the fin blade to bend. This bending occurs perpendicular to the longitudinal axis of the fibers 5, which has the result that the fin blade twists into itself in such a manner that the angle of incidence in the region of the free end 11 of the fin blade 2 increases in relation to the flow. This twisting consequently increases the positive buoyancy. The "active" region between the leading edge 12 and the thick dotted line, whose fibers are not clamped in the fin shaft 3, is relatively small in FIG. 5; the untwisting behavior of the fin is therefore slight.

Figure 6:
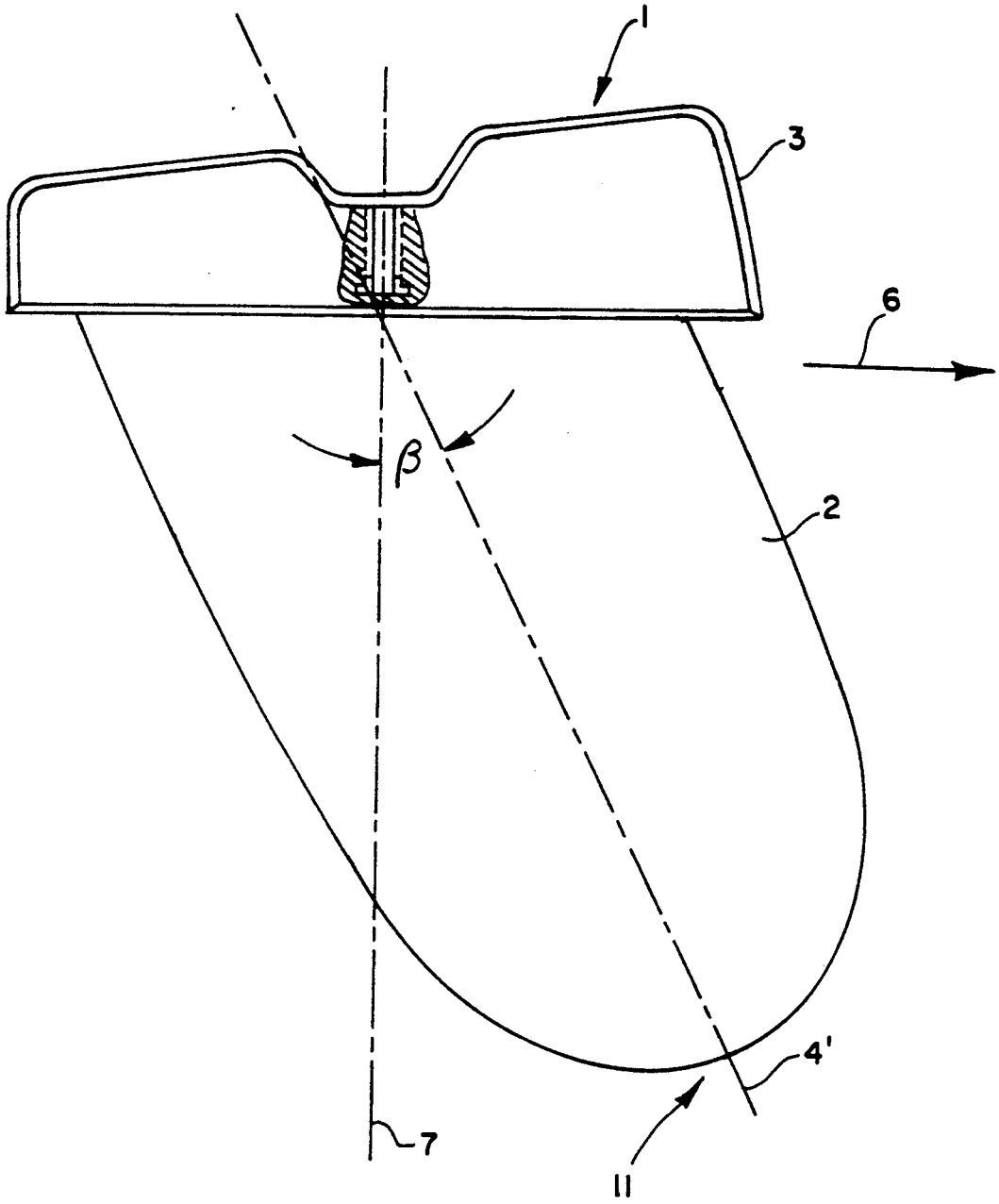
FIG. 6 is a side view of a fin with a forward-swept fin blade.

In the embodiment in FIG. 6, the fin blade 2 is swept forwards in the direction of travel 6, i.e., the main axis 4' of the fin blade is inclined in the direction of travel 6 at an angle $\beta$ in relation to a vertical line 7, so that the free end 11 of the fin shaft points further in the direction of travel than the region lying on the main axis 4' on the side of the shaft. This so-called sweep of the fin blade also has the result that, when the fin blade bends because of positive buoyant forces, the effective angle of incidence $\delta$ in the region 11 is increased in relation to the flow, without the fin blade itself twisting. This effect is due to the fact that the fin blade bends along the main axis 4' and not along the axis 7. Since the fin blade 2 bends progressively starting from the shaft 3, the angle of incidence $\delta$ in relation to the flow also increases progressively starting from the shaft 3, so that the angle of incidence $\delta$ is greatest at the free end 11. Assuming that the cross-sections, dimensions, etc., are the same, the effect of the angles $\alpha$ and $\beta$ (FIG. 2 and/or FIG. 3) will also be seen to be similar, since in both cases the bending line is tilted in the direction of travel 6 relative to a vertical line.

The measures in FIGS. 5 and 6 can also be combined with one another, either to increase the enlarging effect of the angle of incidence in the region 11 or to prevent the angle of sweep $\beta$ from becoming too large, and consequently to prevent the effective extension of the fin, i.e., the ratio of its length (measured in the direction of the main axis 4') relative to its width (measured in the direction of travel), from becoming too small. This is because a fin with a relatively high extension has the best flow properties.

Figure 7:
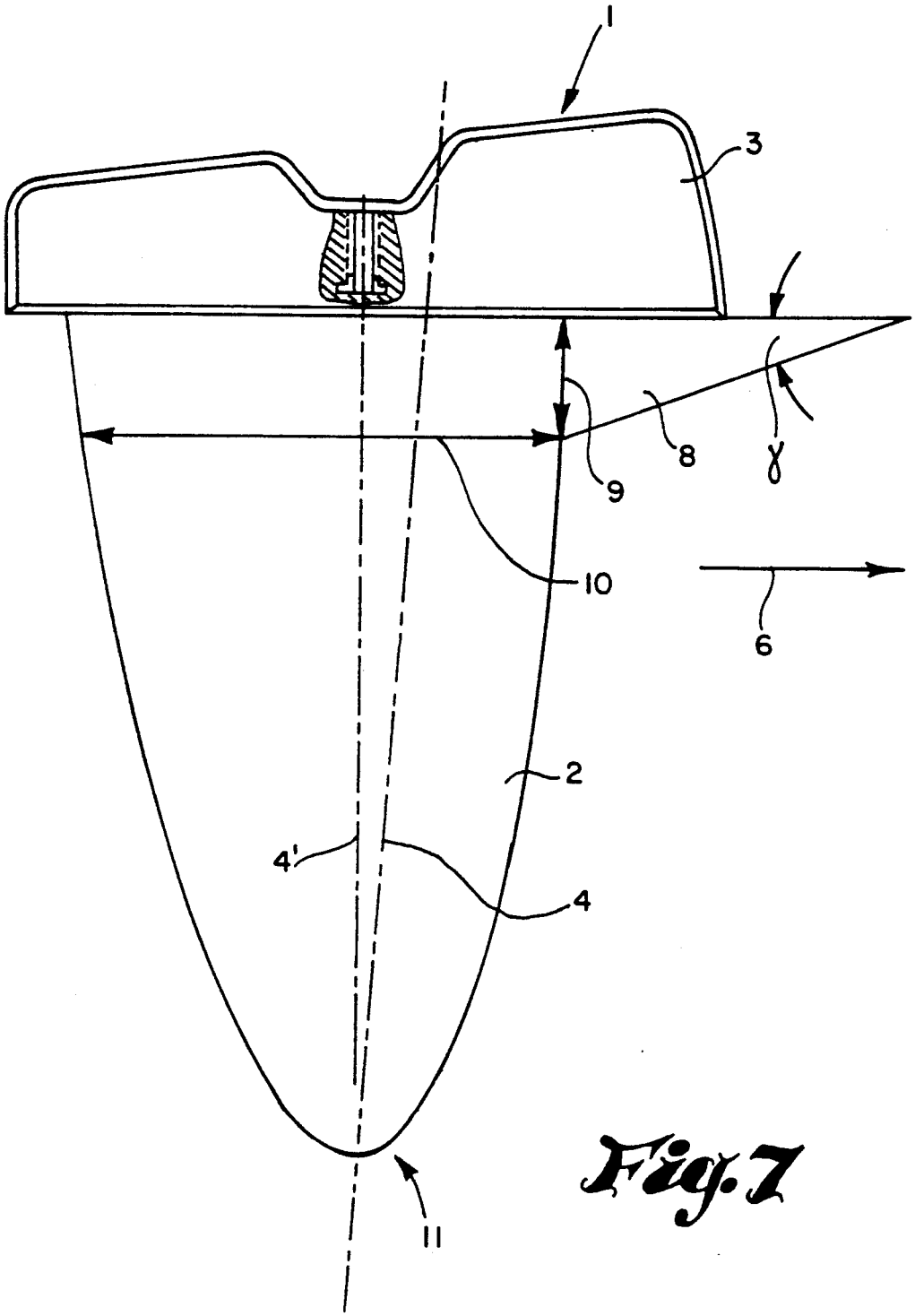
FIG. 7 is a side view of a fin with a profiled body.

In the embodiment in FIG. 7, a triangular profiled body 8 is provided on the region of the fin blade located on the shaft side and pointing in the direction of travel 6, i.e, on the front upper region relative to the direction of travel, the peak of this triangular profiled body 8 pointing in the direction of travel 6. The maximum generating angle $\gamma$ at the peak of the profiled body is 25°. The height 9 of the profiled body on the side of the triangle opposite the generating angle $\gamma$ is at most 25% of the width 10 of the fin blade (measured in the direction of travel 6) which directly adjoins the profiled body 8. In the case of an oblique oncoming flow, this profiled body 8 already generates a wake of turbulence at relatively small angles of incidence, which wake of turbulence runs over the region of the fin blade on the side of the shaft and has the effect that the main flow in this region is pressed against the fin blade. Consequently, the flow separates later in the region on the shaft side than in the region 11, where the effect of the turbulence wake does not occur. The flow will therefore separate earlier in the region 11 of the free end of the fin blade 2, once more giving the desired effect.

Figure 8:
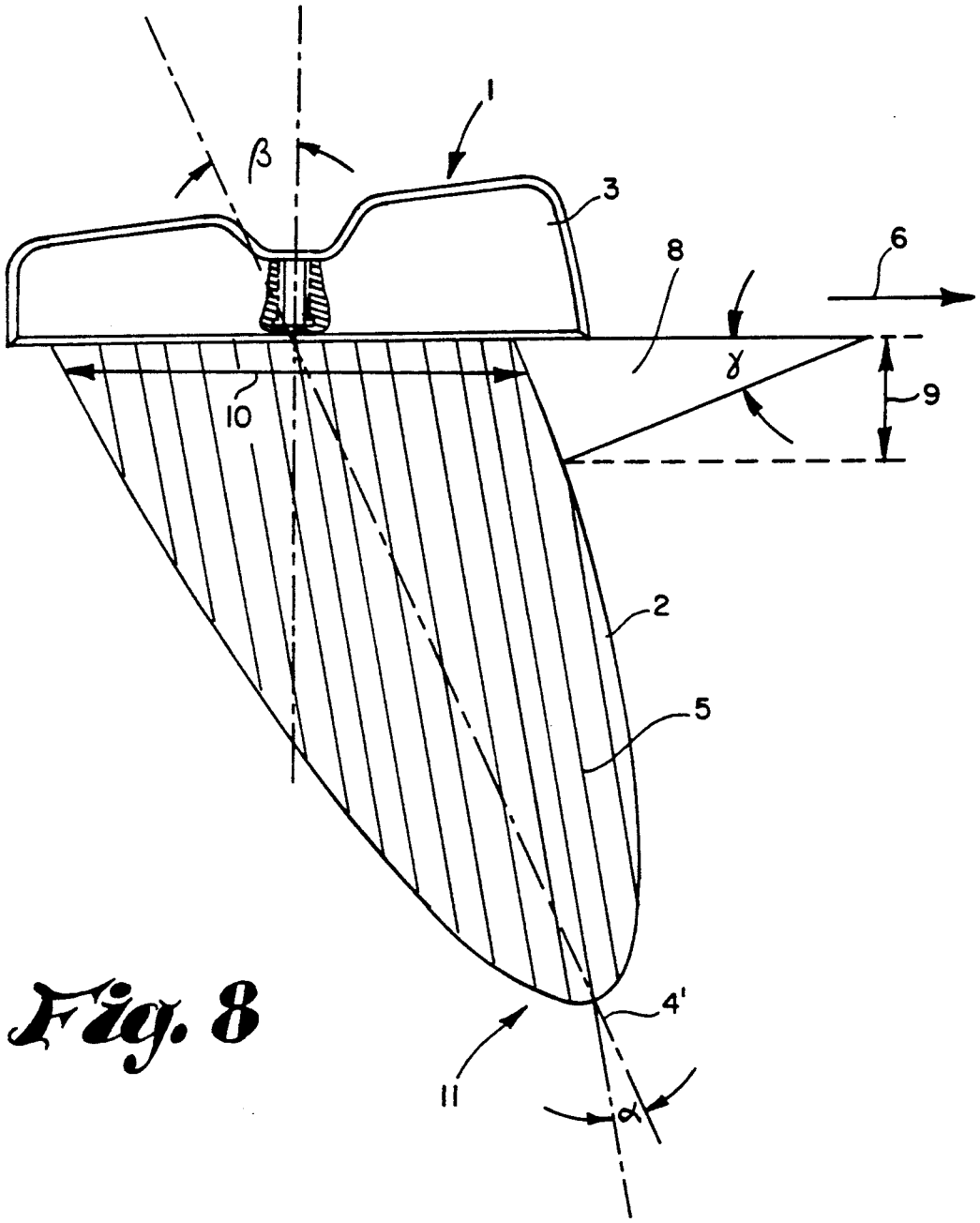
FIG. 8 is a side view of a fin, combining the three measures in accordance with FIGS. 3 to 5.

This measure can also be combined with those of the embodiments in FIGS. 3 to 7. A fin embodying all three measures is shown in FIG. 8.

Finally, it is pointed out that all these measures can also be assisted if the outline of the fin blade is part of an ellipse. An elliptical outline has the effect that the positive buoyant force is distributed substantially uniformly relative to the main axis 4' of the fin blade. The effects of the different variants of the invention leading to the flow separation are not distorted if the outline is given such a contour.

Regarding the embodiments of FIGS. 6 and 7, it should also be noted that it is acceptable for the profiled body 8 to project over the outline of the fin shaft 3; this will not give rise to any disadvantages in terms of the flow. Nor does the upper edge of the profiled body pointing towards the underside of the board need to rest closely against the underside of the board. It is the specific aim of the profiled body 8 to generate a disturbance of the flow, so a small gap between the profiled body and the underside of the board—which also disturbs the flow—does not have any negative influence.

What is claimed is:

1. A fin for a windsurf board having a profiled fin blade constructed from fiber-reinforced plastic, wherein the fin blade has a preferred fiber direction which extends at an acute angle to the longitudinal axis of the profile of the fin blade, the majority of fibers lying in this preferred direction, said acute angle being adjusted so that the fiber ends pointing towards the shaft of the fin lie further back in the direction of travel than the fiber ends pointing towards the free end of the fin blade.

2. A fin according to claim 1, wherein the acute angle is between 0 to 40 degrees.

3. A fin according to claim 1, wherein the longitudinal axis of the profile of the fin blade is inclined at an acute angle relative to the direction of travel.

4. A fin according to claim 3, wherein the acute angle is inclined in the direction of travel in such a manner that the fin blade is swept back relative to the direction of travel.

5. A fin according to claim 3, wherein the acute angle is inclined in the direction of travel in such a manner that the fin blade is swept forwards relative to the direction of travel.

6. A fin according to claim 1, wherein the outline of the fin blade has the shape of an ellipse.

7. A windsurf board having a fin according to claim 1.

8. A fin for a windsurf board having a profiled fin blade constructed form fiber-reinforced plastic, wherein the fin blade has a preferred fiber direction which extends at an acute angle to the longitudinal axis of the profile of the fin blade, the majority of fibers lying in this preferred direction, wherein a substantially triangular profiled body is provided at the end of the fin blade adjacent the shaft of the fin and pointing in the direction of travel, the peak of which profiled body points in the direction of travel and has a maximum generating angle of 25 degrees, and in that the cathelus of the triangle opposite the generating angle has a length which is at most 25% of the length of the part of the fin blade directly adjoining the profiled body, said length being measured in the direction of travel.

* * * * *